US009510408B1

(12) United States Patent
Tseng

(10) Patent No.: US 9,510,408 B1
(45) Date of Patent: Nov. 29, 2016

(54) LIGHT EMITTING DIODE BACKLIGHT MODULE AND DRIVING APPARATUS THEREOF

(71) Applicant: Power Forest Technology Corporation, Hsinchu County (TW)

(72) Inventor: Yang-Tai Tseng, Hsinchu (TW)

(73) Assignee: Power Forest Technology Corporation, Hsinchu (TW)

( * ) Notice: Subject to any disclaimer, the term of this patent is extended or adjusted under 35 U.S.C. 154(b) by 0 days.

(21) Appl. No.: 14/956,394

(22) Filed: Dec. 2, 2015

(30) Foreign Application Priority Data

Sep. 7, 2015 (TW) ..... 104129473 A

(51) Int. Cl.
*H05B 33/08* (2006.01)

(52) U.S. Cl.
CPC ..... *H05B 33/0815* (2013.01)

(58) Field of Classification Search
CPC .. H05B 37/02; H05B 33/08; H05B 33/0815; H05B 33/083; H05B 33/0884; H05B 33/0827; H05B 33/051
USPC ..... 315/122, 185 R, 186, 210, 291, 294, 315/307, 308
See application file for complete search history.

(56) References Cited

U.S. PATENT DOCUMENTS 6,636,003 B2 * 10/2003 Rahm ..... H01L 25/0753 257/E25.02
2009/0134817 A1 * 5/2009 Jurngwirth ..... H05B 33/0851 315/307
2009/0224736 A1 * 9/2009 Santo ..... G05F 1/561 323/274
2012/0074860 A1 * 3/2012 Lee ..... H03K 4/501 315/240
2013/0342124 A1 * 12/2013 Huang ..... H05B 33/0839 315/210

FOREIGN PATENT DOCUMENTS

| | | |
|---|---|---|
| CN | 102244965 | 11/2011 |
| CN | 103517503 | 1/2014 |
| TW | 201138553 | 11/2011 |
| TW | 201526572 | 7/2015 |

OTHER PUBLICATIONS

"Office Action of Taiwan Counterpart Application", issued on Jul. 25, 2016, p. 1-p. 3.

* cited by examiner

*Primary Examiner* — Thai Pham
(74) *Attorney, Agent, or Firm* — Jianq Chyun IP Office

(57) ABSTRACT

A LED backlight module including a LED string and a driving apparatus is provided. The driving apparatus comprises a sensing resistor, an adjustable voltage-divider circuit, a comparator, a power converter and a control circuit. The sensing resistor is coupled between a cathode of the LED string and a ground potential and generates a feedback voltage. The adjustable voltage-divider circuit generates a reference voltage according to a dividing ratio which is controlled by a first signal set and a second signal set. The comparator compares the feedback voltage and the reference voltage, and generates a control signal accordingly. The power converter provides a DC voltage to an anode of the LED string according to the control signal. The control circuit counts a disable period of a dimming signal to generate the first signal set, and counts an enable period of the dimming signal to generate the second signal set.

18 Claims, 4 Drawing Sheets

LIGHT EMITTING DIODE BACKLIGHT MODULE AND DRIVING APPARATUS THEREOF

CROSS-REFERENCE TO RELATED APPLICATION

This application claims the priority benefit of Taiwan application serial no. 104129473, filed on Sep. 7, 2015. The entirety of the above-mentioned patent application is hereby incorporated by reference herein and made a part of this specification.

BACKGROUND

Field of the Invention

The invention is directed to a driving technique of a light emitting diode (LED) and more particularly, to an LED backlight module and driving apparatus.

Description of Related Art

In recent years, with the rapid development of semiconductor technology, portable electronic products and flat panel display products also become popular. Among a variety of types of flat panel displays, a liquid crystal display (LCD) has become a main stream in various display products due to its advantages of low voltage operation, no irradiation, light weight, small volume, etc. Generally, since an LCD panel is not self-luminous, a backlight module has to be disposed under the LCD panel to provide a light source for the LCD panel.

Conventional backlight modules are approximately classified as two types. One is a backlight module composed of cold cathode fluorescent lamps (CCFLs), and the other is a backlight module composed of light-emitting diodes (LEDs). Since the LED backlight module may enhance a color gamut of the LCD, various display panel manufacturers generally use the LED backlight module to replace the CCFL backlight module.

The LED backlight module has a plurality of LED strings arranged in parallel, and each of the LED strings is composed of a plurality of LEDs connected in series. Basically, all LED strings can be operated in a system voltage generated by a boost unit, so as to maintain a current flowing through each LED string at the same constant current.

On the other hand, in some applications, there might be requirements for adjusting brightness because of being cooperated with ambient light or the displayed frames being different. At this current stage, a most commonly used method includes providing a dimming signal, filtering the dimming signal through external capacitors and resistors to generate an analog voltage signal, and then comparing the analog voltage signal with a feedback voltage signal from the LED string to control the system voltage, so as to achieve the purpose of dimming. However, in this method, a driving apparatus equipped with the LED string needs additional pins for connecting the external capacitors. Besides, a frequency of the dimming signal cannot be too low, or the filtered analog voltage signal will become distorted and cannot accurately adjust the brightness of the image frames.

SUMMARY

Accordingly, the invention provides a light emitting diode (LED) backlight module and a driving apparatus thereof, where the driving apparatus is capable of converting a pulse width modulation (PWM) based dimming signal into an analog voltage signal without connecting any external capacitor and accurately adjusting brightness of a displayed image frame according to the dimming signal at any frequency.

According to an embodiment of the invention, an LED driving apparatus adapted to drive at least one LED string is provided. The LED driving apparatus includes a sensing resistor, an adjustable voltage-divider circuit, a comparator, a power converter and a control circuit. A first terminal of the sensing resistor is coupled to a cathode of the at least one LED string to generate a feedback voltage, and a second terminal of the sensing resistor is coupled to a ground potential. The adjustable voltage-divider circuit is configured to generate a reference voltage according to a dividing ratio, wherein the dividing ratio of the adjustable voltage-divider circuit is controlled by a first signal set and a second signal set. A first input terminal of the comparator is coupled to the first terminal of the sensing resistor to receive the feedback voltage, a second input terminal of the comparator is coupled to the adjustable voltage-divider circuit to receive the reference voltage, and an output terminal of the comparator is configured to generate a control signal. The power converter is coupled between the output terminal of the comparator and an anode of the at least one LED string and configured to provide a DC voltage to the anode of the at least one LED string according to the control signal. The control circuit is coupled to the adjustable voltage-divider circuit and configured to receive the dimming signal. The control circuit counts a disable period of the dimming signal to generate the first signal set and counts an enable period of the dimming signal to generate the second signal set.

In an embodiment of the invention, the adjustable voltage-divider circuit includes a first controllable resistor and a second controllable resistor. A first terminal of the first controllable resistor is coupled to a power potential, and a second terminal of the first controllable resistor is coupled to a first node. A first terminal of the second controllable resistor is coupled to the first node to generate the reference voltage, and a second terminal of the second controllable resistor is coupled to the ground potential. The first controllable resistor is controlled by the first signal set to adjust a resistance of the first controllable resistor, and the second controllable resistor is controlled by the second signal set to adjust a resistance of the second controllable resistor.

In an embodiment of the invention, an equivalent resistance of the first controllable resistor is positively correlated to a length of the disable period of the dimming signal, and an equivalent resistance of the second controllable resistor is positively correlated to a length of the enable period of the dimming signal.

In an embodiment of the invention, the first controllable resistor includes a plurality of switching resistor modules. The switching resistor modules are sequentially connected in series. A first-stage switching resistor module among the switching resistor modules is coupled to the power potential, a last-stage switching resistor module among the switching resistor modules is coupled to the first node. Each of the switching resistor modules is controlled by at least one corresponding signal in the first signal set to change the resistance of the first controllable resistor.

In an embodiment of the invention, each of the switching resistor modules includes a resistor module and a switch module. The switch module is connected in parallel with the resistor module. The switch module is controlled by the at least one corresponding signal in the first signal set to determine a resistance of the switching resistor module.

In an embodiment of the invention, the resistor module includes one or more resistors sequentially connected in series or connected in parallel with one another. The switch module includes one or more switches sequentially connected in series, and the switches are turned on/turned off respectively according to at least one corresponding signal in the second signal set.

In an embodiment of the invention, the second controllable resistor includes a plurality of switching resistor modules sequentially connected in series. A first-stage switching resistor module among the switching resistor modules is coupled to the first node. A last-stage switching resistor module among the switching resistor modules is coupled to the ground potential. Each of the switching resistor modules is controlled by the at least one corresponding signal in the second signal set to change the resistance of the second controllable resistor.

In an embodiment of the invention, the control circuit includes an edge detecting circuit, a counter and a sampling circuit. The edge detecting circuit is configured to receive the dimming signal, and detects a rising edge and a falling edge of the dimming signal to generate a reset signal. The counter is configured to receive an input clock signal and coupled to the edge detecting circuit to receive the reset signal. The counter generates a count value in response to the input clock signal and resets the count value in response to the reset signal. The sampling circuit is configured to receive the dimming signal and coupled to the counter to receive the count value. The sampling circuit samples the count value according to the falling edge of the dimming signal to serve as the second signal set and samples the count value according to the rising edge of the dimming signal to serve as the first signal set.

According to an embodiment of the invention, an LED backlight module including at least one LED string and the above-mentioned LED driving apparatus are provided. The LED driving apparatus is coupled to the at least one LED string to drive the at least one LED string.

To sum up, in the LED backlight module and the driving apparatus thereof provided by the embodiments of the invention, the control circuit can count the time lengths of the disable period and the enable period of the dimming signal to generate the first signal set and the second signal set, respectively. The adjustable voltage-divider circuit can adjust the dividing ratio thereof according to the first signal set and the second signal set to generate the reference voltage. The reference voltage generated according to the dividing ratio can substantially represent a duty cycle of the dimming signal. Thereby, the driving apparatus can convert the PWM-based dimming signal into the reference voltage without connecting external capacitors. In this way, the dimming signal at a low frequency can also be accurately converted into the reference voltage. Additionally, as the duty cycle of the dimming signal is changed, the reference voltage is also changed, such that the feedback voltage and a current flowing through the LED string are also changed accordingly, and the brightness of the LED string can be accurately adjusted.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
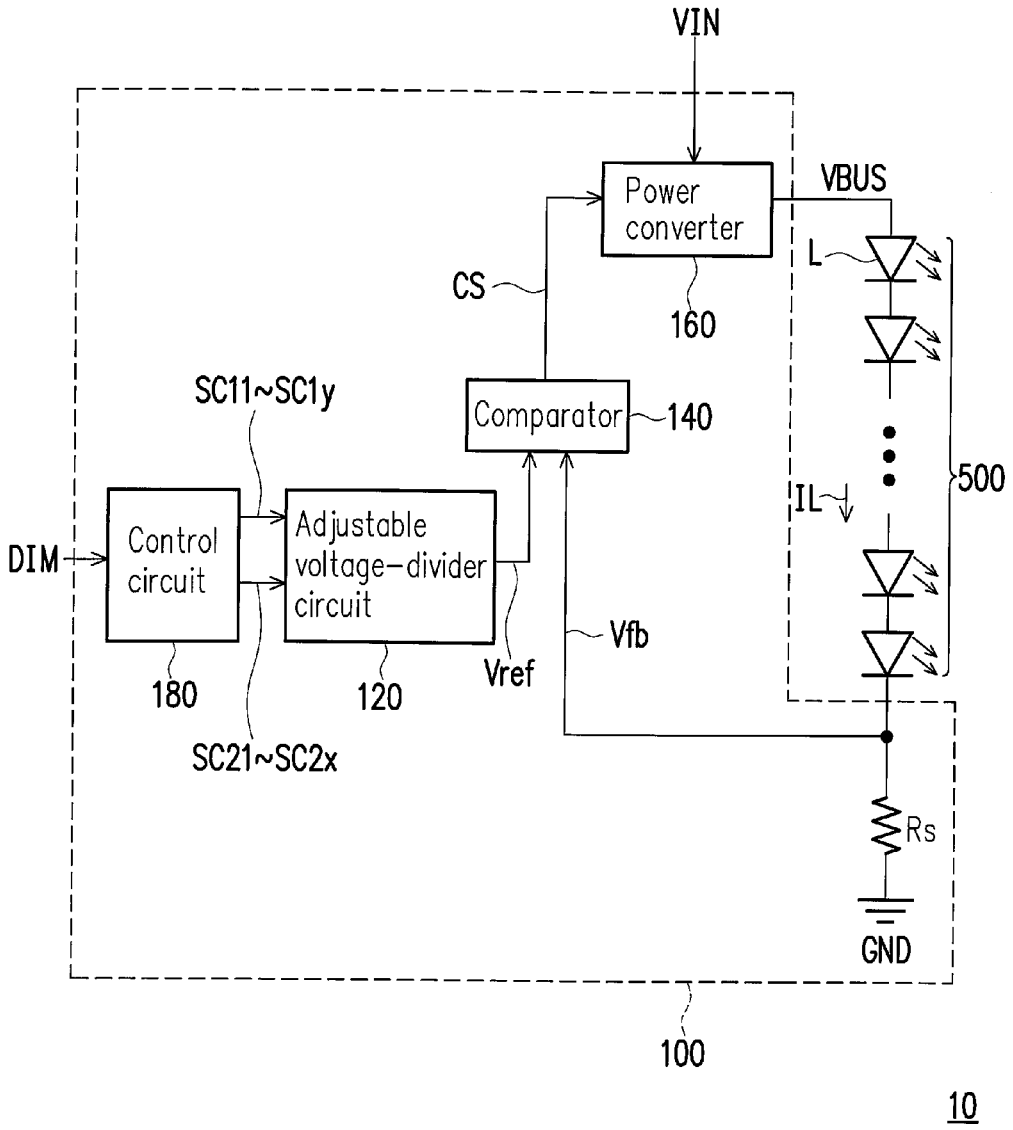
FIG. 1 is a schematic diagram illustrating a light emitting diode (LED) backlight module according to an exemplary embodiment of the invention.

Reference will now be made in detail to the exemplary embodiments of the disclosure, examples of which are illustrated in the accompanying drawings. Wherever possible, the same reference numbers are used in the drawings and the description-Refer to the same or like parts.

FIG. 1 is a schematic diagram illustrating a light emitting diode (LED) backlight module 10 according to an exemplary embodiment of the invention. Referring to FIG. 1, the LED backlight module 10 may be applied in a liquid crystal display (LCD) system, but the invention is not limited thereto. The LED backlight module 10 includes N LED strings and a driving apparatus 100. In the present exemplary embodiment, N may be a positive integer greater than or equal to 1; however, for convenient description, it is assumed that N is equal to 1, and other exemplary embodiments in which N is greater than 1 may be inferred according to the description set forth below. Thus, the LED backlight module 10 includes an LED string 500, and the LED string 500 includes a plurality of LEDs L connected in series.

Additionally, the driving apparatus 100 is coupled to the LED string 500 to drive the LED string 500. As illustrated in FIG. 1, the driving apparatus 100 includes a sensing resistor Rs, an adjustable voltage-divider circuit 120, a comparator 140, a power converter 160 and a control circuit 180, but the invention is not limited thereto. A first terminal of the sensing resistor Rs is coupled to a cathode of the LED string 500, and a second terminal of the sensing resistor Rs is coupled to a ground potential GND. The sensing resistor Rs senses a current IL flowing through the LED string 500 to accordingly generate a feedback voltage Vfb. The adjustable voltage-divider circuit 120 is configured to generate a reference voltage Vref according to a dividing ratio, where the dividing ratio of the adjustable voltage-divider circuit 120 is controlled by a first signal set SC11-SC1*y* and a second signal set SC21-SC2*x*.

A first input terminal of the comparator 140 is coupled to the first terminal of the sensing resistor Rs to receive the feedback voltage Vfb, a second input terminal of the comparator 140 is coupled to the adjustable voltage-divider circuit 120 to receive the reference voltage Vref, and an output terminal of the comparator 140 is configured to generate a control signal CS. The power converter 160 is coupled between the output terminal of the comparator 140 and an anode of the LED string 500. The power converter 160 is configured to receive an input voltage VIN. The power converter 160 performs a boost-buck process on the received input voltage VIN according to the control signal CS and adopting a pulse width modulation (PWM) control mechanism to provide a DC voltage VBUS to the anode of the LED string 500.

The control circuit 180 is coupled to the adjustable voltage-divider circuit 120. The control circuit 180 is configured to receive a dimming signal DIM. The control circuit 180 counts a disable period of the dimming signal DIM to generate the first signal set SC11-SC1*y* and counts enable period of the dimming signal DIM to generate the second signal set SC21-SC2*x*.

In overall operation, the control circuit 180 counts the disable period and the enable period of the dimming signal DIM to generate the first signal set SC11-SC1*y* and the second signal set SC21-SC2*x*, respectively. Thus, a value represented by the first signal set SC11-SC1*y* is correlated to a time length of the disable period of the dimming signal DIM, and a value represented by the second signal set SC21-SC2*x* is correlated to a time length of the enable period of the dimming signal DIM. Additionally, the adjustable voltage-divider circuit 120 adjusts the dividing ratio to generate the reference voltage Vref according to the first signal set SC11-SC1*y* and the second signal set SC21-SC2*x*. Thus, a voltage level of the reference voltage Vref generated according to the dividing ratio may substantially represent a duty cycle of the dimming signal DIM. Accordingly, the dimming signal DIM may be converted into the reference voltage Vref through the control circuit 180 and the adjustable voltage-divider circuit 120. In other words, the driving apparatus 100 provided by the invention may achieve converting the dimming signal DIM into the reference voltage Vref without connecting any external capacitor.

Then, the comparator 140 compares the reference voltage Vref and the feedback voltage Vfb to generate the control signal CS. The power converter 160 adjusts and provides the DC voltage VBUS according to the control signal CS. In detail, when the DC voltage VBUS is dropped, the feedback voltage Vfb sensed by the sensing resistor Rs is also dropped. When the feedback voltage Vfb is lower than the reference voltage Vref, the power converter 160 adjusts the DC voltage VBUS according to the control signal CS to rise a voltage level of the DC voltage VBUS, such that a voltage level of the feedback voltage Vfb is increased and maintained at the voltage level of the reference voltage Vref, and vice versa.

From the other perspective, when the duty cycle of the dimming signal DIM is changed, the voltage level of the reference voltage Vref is also changed, such that the feedback voltage Vfb is also changed (because the feedback voltage Vfb is maintained at the voltage level of the reference voltage Vref). In response to the feedback voltage Vfb, the current IL flowing through the LED string 500 is also changed (i.e., the current IL=Vfb÷Rs), and thereby, the brightness of the LED string 500 is changed as well. Accordingly, the dimming of the LED string 500 can be achieved through adjusting the duty cycle of the dimming signal DIM.

In an embodiment of the invention, the power converter 160 may be implemented by using a boost circuit or a buck circuit, but the invention is not limited thereto. The power converter 160 of the invention may also be implemented by using other power converting circuits.

Figure 2:
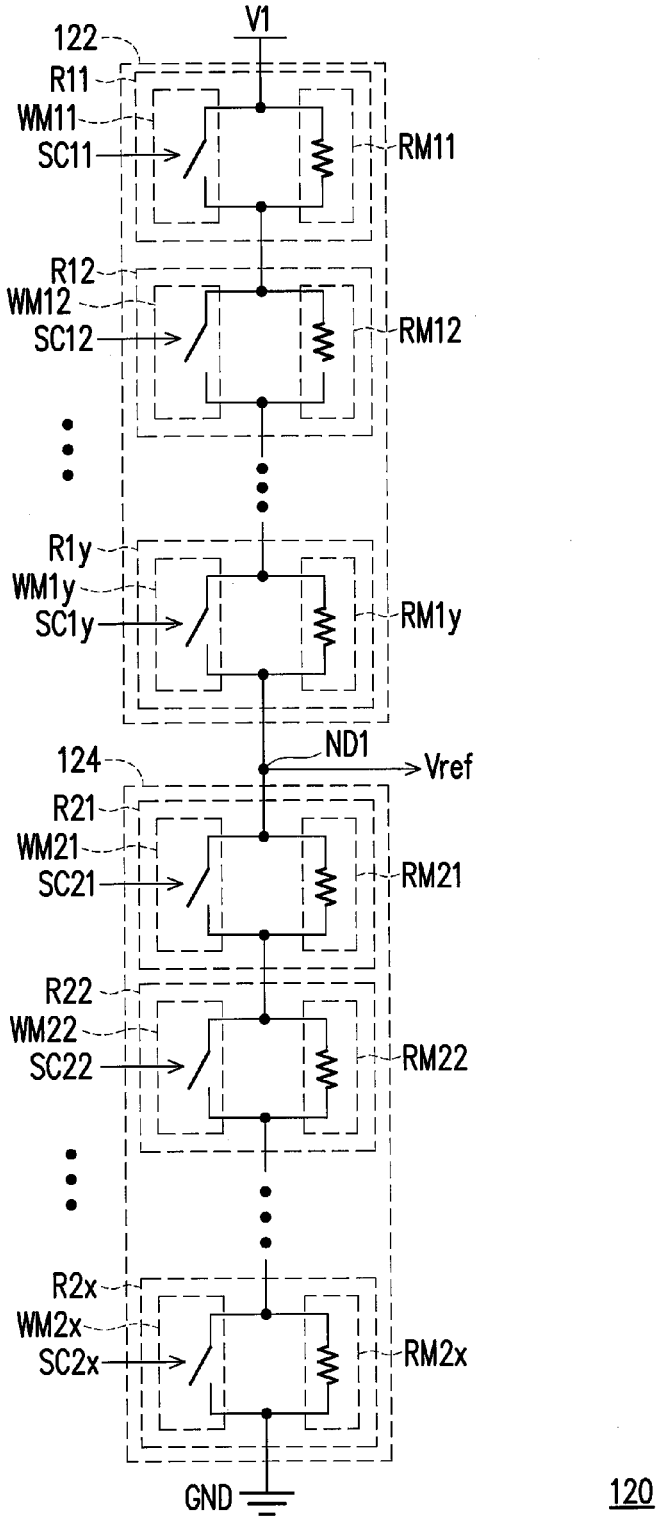
FIG. 2 is a schematic circuit diagram illustrating the adjustable voltage-divider circuit depicted in FIG. 1.

Referring to FIG. 2 hereinafter, FIG. 2 is a schematic circuit diagram illustrating the adjustable voltage-divider circuit 120 depicted in FIG. 1. The adjustable voltage-divider circuit 120 includes a first controllable resistor 122 and a second controllable resistor 124. A first terminal of the first controllable resistor 122 is coupled to a power potential V1, where the voltage level of the power potential V1 may be determined based on actual application or design requirements. A second terminal of the first controllable resistor 122 is coupled to a first node ND1. A first terminal of the second controllable resistor 124 is coupled to the first node ND1 to generate the reference voltage Vref, and a second terminal of the second controllable resistor 124 is coupled to the ground potential GND.

Specially, the first controllable resistor 122 is controlled by the first signal set SC11-SC1*y* to adjust a resistance of the first controllable resistor 122, and the second controllable resistor 124 is controlled by the second signal set SC21-SC2*x* to adjust a resistance of the second controllable resistor 124. Furthermore, an equivalent resistance of the first controllable resistor 122 is positively correlated to the time length of the disable period of the dimming signal DIM, and an equivalent resistance of the second controllable resistor 124 is positively correlated to the time length of the enable period of the dimming signal DIM.

In an embodiment of the invention, the first controllable resistor 122 includes Y switching resistor modules R11-R1*y*. Referring to FIG. 2, the switching resistor modules R11-R1*y* are sequentially connected in series, where a first-stage switching resistor module R11 is coupled to the power potential V1, a last-stage switching resistor module R1*y* is coupled to the first node ND1, but the invention is not limited thereto. The switching resistor module R11 may be controlled by one corresponding signal (e.g., SC11) in the first signal set SC11-SC1*y* to change the resistance of the first controllable resistor 122. The switching resistor module R12 may be controlled by another one corresponding signal (e.g., SC12) in the first signal set SC11-SC1*y* to change the resistance of the first controllable resistor 122. Likewise, the switching resistor module R1*y* may be controlled by yet another one corresponding signal (e.g., SC1*y*) in the first signal set SC11-SC1*y* to change the resistance of the first controllable resistor 122. The others may be deduced in the same way.

In other embodiments of the invention, each of the switching resistor modules R11-R1*y* may also be controlled by a plurality of corresponding signals in the first signal set SC11-SC1*y* to change the resistance of the first controllable resistor 122. For example, if the switching resistor module R11 determines a resistance of the switching resistor module R11 according to whether a plurality of switches therein is turned on, then the switching resistor module R11 may also be controlled by a plurality of corresponding signals in the first signal set SC11-SC1*y* to change the resistance of the first controllable resistor 122.

It is to be noted that in the exemplary embodiments described above, the number, Y, of the switching resistor modules R11-R1*y* may be a positive integer greater than 1, and the number Y may be determined based on actual application or design requirements. It may be understood that the greater the number Y is, the higher the resolution with respect to the resistance of the first controllable resistor 122 is, and thus, the reference voltage Vref generated by the adjustable voltage-divider circuit 120 will be more accurate.

Description with respect to the switching resistor modules R11-R1*y* will be set forth hereinafter. The switching resistor module R11 includes a resistor module RM11 and a switch module WM11. The switch module WM11 is connected in parallel with the resistor module RM11 and controlled by the corresponding signal (i.e., SC11) in the first signal set SC11-SC1*y* to determine the resistance of the switching resistor module R11. The switching resistor module R12 includes a resistor module RM12 and a switch module WM12. The switch module WM12 is connected in parallel with the resistor module RM12 and controlled by the corresponding signal (i.e., SC12) in the first signal set SC11-SC1y to determine the resistance of the switching resistor module R12. Likewise, the switching resistor module R1y includes a resistor module RMly and a switch module WM1y. The switch module WM1y is connected in parallel with the resistor module RMly and controlled by the corresponding signal (i.e., SC1y) in the first signal set SC11-SC1y to determine the resistance of the switching resistor module R1y. The others may be deduced in the same way.

Due to the switching resistor modules R11-R1y having the similar structures and operations, the resistor module RM11 and the switch module WM11 of the switching resistor module R11 will be described for example below, and the structures and the operations of the rest, i.e., the switching resistor modules R12-R1y, may be inferred in the same way.

In an embodiment of the invention, the resistor module RM11 may include one or more resistors. If the resistor module RM11 has a plurality of resistors, the resistors may be sequentially connected in series or connected in parallel with one another. The switch module WM11 may include one or more switches. If the switch module WM11 has a plurality of switches, the switches may be sequentially connected in series, and the switches may be turned on or turned off respectively according to the corresponding signals (e.g., SC11) in the first signal set SC11-SC1y.

It may be understood that when the switch module WM11 of the switching resistor module R11 is turned on, a short circuit occurs to the two terminals of the resistor module RM11 as the switch module WM11 is turned on, and thus, an effective resistance of the switching resistor module R11 may be substantially considered as 0 ohm (Ω). On the contrary, when the switch module WM11 of the switching resistor module R11 is turned off, the effective resistance of the switching resistor module R11 is substantially the resistance of the resistor module RM11. In this way, the turning on/turning off of the switch modules WM11-WM1y may be controlled through the first signal set SC11-SC1y, so as to adjust the resistance of the first controllable resistor 122.

In an embodiment of the invention, the second controllable resistor 124 includes X switching resistor modules R21-R2x. Referring to FIG. 2, the switching resistor modules R21-R2x are sequentially connected in series, where a first-stage switching resistor module R21 is coupled to the first node ND1, and a last-stage switching resistor module R2x is coupled to the ground potential GND, but the invention is not limited thereto. The switching resistor modules R21 may be controlled by one corresponding signal (e.g., SC21) in the second signal set SC21-SC2x to change the resistance of the second controllable resistor 124. The switching resistor module R22 may be controlled by one corresponding signal (e.g., SC22) in the second signal set SC21-SC2x to change the resistance of the second controllable resistor 124. Likewise, the switching resistor module R2x may be controlled by one corresponding signal (e.g., SC2x) in the second signal set SC21-SC2x to change the resistance of the second controllable resistor 124. The others may be deduced in the same way.

In other embodiments of the invention, each of the switching resistor modules R21-R2x may also be controlled by a plurality of corresponding signals in the second signal set SC21-SC2x to change the resistance of the second controllable resistor 124. For example, if the switching resistor module R21 determines a resistance of the switching resistor module R21 according to whether a plurality of switches therein is turned on, then the switching resistor module R21 may also be controlled by a plurality of corresponding signals in the second signal set SC21-SC2x to change the resistance of the resistance of the second controllable resistor 124.

It is to be noted that in the exemplary embodiments described above, the number, X, of the switching resistor modules R21-R2x may be a positive integer greater than 1, and the number X may be determined based on actual application or design requirements. It may be understood that the greater the number X is, the higher the resolution with respect to the resistance of the second controllable resistor 124 is, and thus, the reference voltage Vref generated by the adjustable voltage-divider circuit 120 will be more accurate.

Description with respect to the switching resistor modules R21-R2x will be set forth hereinafter. The switching resistor module R21 includes a resistor module RM21 and a switch module WM21. The switch module WM21 is connected in parallel with the resistor module RM21 and controlled by the corresponding signal (i.e., SC21) in the second signal set SC21-SC2x to determine the resistance of the switching resistor module R21. The switching resistor module R22 includes a resistor module RM22 and a switch module WM22. The switch module WM22 is connected in parallel with the resistor module RM22 and controlled by the corresponding signal (i.e., SC22) in the second signal set SC21-SC2x to determine the resistance of the switching resistor module R22. Likewise, the switching resistor module R2x includes a resistor module RM2x and a switch module WM2x. The switch module WM2x is connected in parallel with the resistor module RM2x and controlled by the corresponding signal (i.e., SC2x) in the second signal set SC21-SC2x to determine the resistance of the switching resistor module R2x. The others may be deduced in the same way.

Due to the switching resistor modules R21-R2x having the similar structures and operations, the resistor module RM21 and the switch module WM21 of the switching resistor module R21 will be described for example below, and the structures and the operations of the rest, i.e., the switching resistor modules R12-R1y, may be inferred in the same way.

In an embodiment of the invention, the resistor module RM21 may include one or more resistors. If the resistor module RM21 has a plurality of resistors, the resistors may be sequentially connected in series or connected in parallel with one another. The switch module WM21 may include one or more switches. If the switch module WM21 has a plurality of switches, the switches may be sequentially connected in series, and the switches may be turned on or turned off respectively according to the corresponding signals (e.g., SC21) in the second signal set SC21-SC2x.

It may be understood that when the switch module WM21 of the switching resistor module R21 is turned on, a short circuit occurs to the two terminals of the resistor module RM21 as the switch module WM21 is turned on, and thus, an effective resistance of the switching resistor module R21 may be substantially considered as 0Ω On the contrary, when the switch module WM21 of the switching resistor module R21 is turned off, the effective resistance of the switching resistor module R21 is substantially the resistance of the resistor module RM21. In this way, the turning on/turning off of the switch modules WM21-WM2x may be controlled through the second signal set SC21-SC2x so as to adjust the resistance of the second controllable resistor 124.

Figure 3:
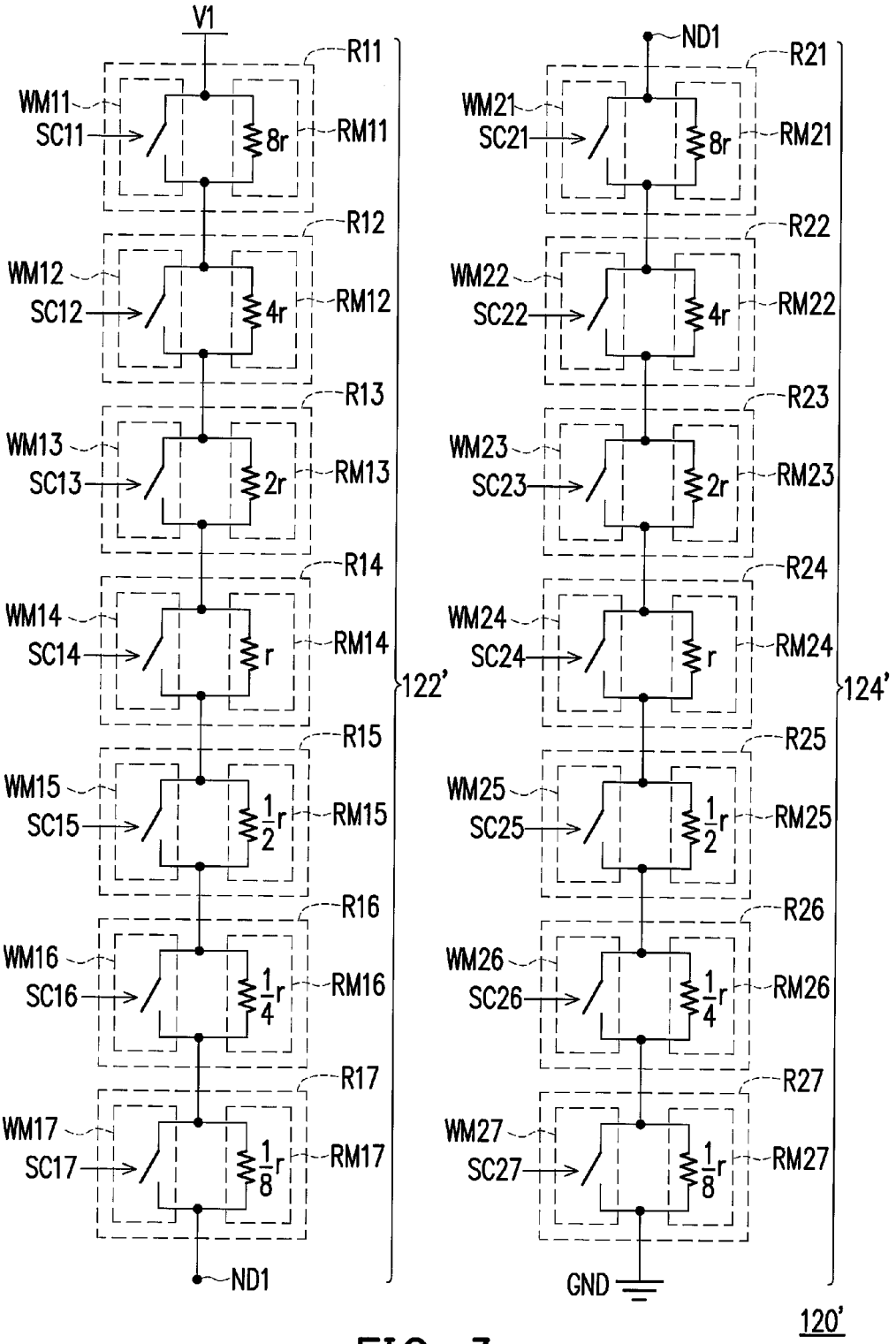
FIG. 3 is a schematic diagram illustrating an implementation example of the adjustable voltage-divider circuit depicted in FIG. 2.

Referring to both FIG. 2 and FIG. 3 hereinafter, FIG. 3 illustrates an adjustable voltage-divider circuit 120', which is an implementation example of the adjustable voltage-divider circuit 120 depicted in FIG. 2. The adjustable voltage-divider circuit 120', in the same way, includes a first controllable resistor 122' and a second controllable resistor 124', where the first controllable resistor 122' includes 7 switching resistor modules R11-R17 (i.e., Y=7), and the second controllable resistor 124' includes 7 switching resistor modules R21-R27 (i.e., X=7). The coupling and operation manners of the switching resistor modules R11-R17 illustrated in FIG. 3 may be deduced with reference to the descriptions related to the switching resistor modules R11-R1*y* illustrated in FIG. 2, and the coupling and operation manners of the of the switching resistor modules R21-R27 illustrated in FIG. 3 may be deduced with reference to the descriptions related to the switching resistor modules R21-R2*x* illustrated in FIG. 2.

It is to be mentioned that resistances of the resistor modules RM11-RM17 of the switching resistor modules R11-R17 may be 8r, 4r, 2r, r, (½)r, (¼)r and (⅛)r, respectively, and resistances of the resistor modules RM21-RM27 of the switching resistor modules R21-R27 may be 8r, 4r, 2r, r, (½)r, (¼)r and (⅛)r, respectively. It assumed herein that the switch modules WM11 to WM17 may be turned off respectively in response to the first signal set SC11-SC17 with logic "1" and may be turned on respectively in response to the first signal set SC11-SC17 with logic "0". Therefore, when disable period of the dimming signal DIM is gradually increased that a value represented by the first signal set SC11-SC17 obtained through counting by the control circuit 180 is also increased, a value represented by the first signal set SC11-SC17 is changed from a binary value "0000001" (whose decimal value is 1) to a binary value "0000010" (whose decimal value is 2), such that a resistance of the first controllable resistor 122' rises up from (⅛)r to (¼)r. Accordingly, the resistance of the first controllable resistor 122' is substantially proportional to the time length of the disable period of the dimming signal DIM. Likewise, a resistance of the second controllable resistor 124' is substantially proportional to the time length of the enable period of the dimming signal DIM.

It may be understood that each of the resistor modules RM11 and RM21 may be formed by 8 resistors each with a resistance of r connected in series; each of the resistor modules RM12 and RM22 may be formed by 4 resistors each with a resistance of r connected in series; each of the resistor modules RM13 and RM23 may be formed by 2 resistors each with a resistance of r connected in series; each of the resistor modules RM15 and RM25 may be formed by 2 resistors each with a resistance of r connected in parallel; each of the resistor modules RM16 and RM26 may be formed by 4 resistors each with a resistance of r connected in parallel; and each of the resistor modules RM17 and RM27 may be formed by 8 resistors each with a resistance of r connected in parallel, but the invention is not limited thereto.

Figure 4:
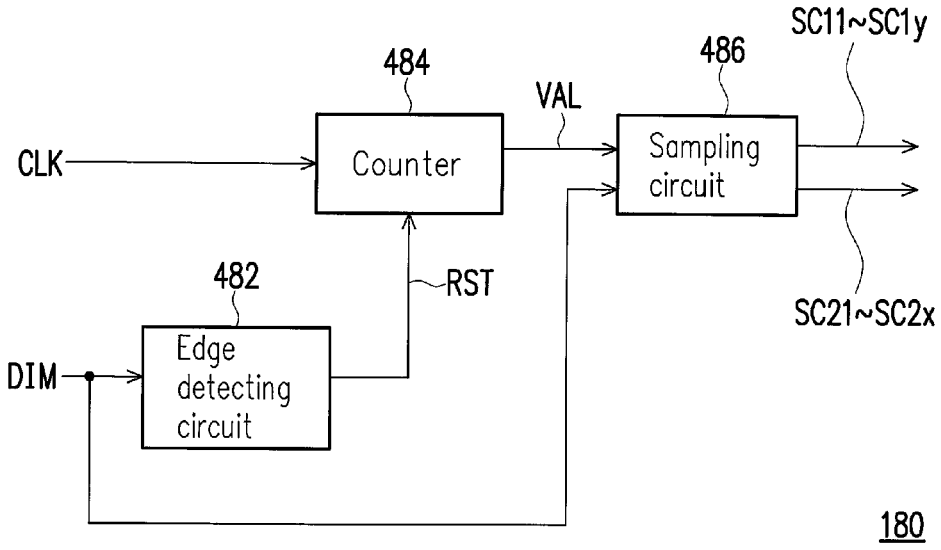
FIG. 4 is a schematic block circuit diagram illustrating the control circuit depicted in FIG. 1.

Referring to FIG. 4 hereinafter, FIG. 4 is a schematic block circuit diagram illustrating the control circuit 180 depicted in FIG. 1. The control circuit 180 includes an edge detecting circuit 482, a counter 484 and a sampling circuit 486. The edge detecting circuit 482 is configured to receive the dimming signal DIM and detect a rising edge and a falling edge of the dimming signal DIM to generate a reset signal RST. The counter 484 is configured to receive the input clock signal CLK and is coupled to the edge detecting circuit 482 to receive the reset signal RST. The counter 484 generates a count value VAL in response to the input clock signal CLK and resets the count value VAL in response to the reset signal RST. The sampling circuit 486 is configured to receive dimming signal DIM and is coupled to the counter 484 to receive the count value VAL. The sampling circuit 486 samples the count value VAL according to the falling edge of the dimming signal DIM to serve as the second signal set SC21-SC2*x* and samples the count value VAL according to the rising edge of the dimming signal DIM to serve as the first signal set SC11-SC1*y*.

Referring to FIG. 1, FIG. 2 and FIG. 4 together, when the dimming signal DIM is changed from a logic-low level to a logic-high level, the edge detecting circuit 482 generates the reset signal RST to reset the counter 484 (i.e., reset the count value VAL). Then, the counter 484 counts a time length of the dimming signal DIM being at the logic-high level (e.g., in the enable period) in response to the triggering of the input clock signal CLK (i.e., the counter 484 accumulates the count value VAL). When the dimming signal DIM is changed from the logic-high level to the logic-low level, the sampling circuit 486 samples the count value VAL according to the falling edge of the dimming signal DIM to serve as the second signal set SC21-SC2*x*, and the edge detecting circuit 482 generates the reset signal RST again to reset the counter 484 (i.e., reset the count value VAL). Then, the counter 484 counts a time length of the dimming signal DIM being at the logic-low level (e.g., in the disable period) in response to the triggering of the input clock signal CLK (i.e., the counter 484 accumulates the count value VAL). When the dimming signal DIM is again changed from the logic-low level to the logic-high level, the sampling circuit 486 samples the count value VAL according to the rising edge of the dimming signal DIM to serve as the first signal set SC11-SC1*y*, and the edge detecting circuit 482 generates the reset signal RST again to reset the counter 484 (i.e., reset the count value VAL). In this way, the counting operation is repeatedly performed to calculate time lengths of the enable period and the disable period of the dimming signal DIM and output the first signal set SC11-SC1*y* and the second signal set SC21-SC2*x* to the adjustable voltage-divider circuit 120 to change the dividing ratio of the adjustable voltage-divider circuit 120, such that the adjustable voltage-divider circuit 120 generates the reference voltage Vref according to the dividing ratio.

In an embodiment of the invention, the edge detecting circuit 482, the counter 484 and the sampling circuit 486 of the control circuit 180 may be implemented in a form of hardware, such as application-specific integrated circuits (ASIC) or field programmable gate array (FPGA), but the invention is not limited thereto. In other embodiments of the invention, the control circuit 180 may also be implemented in a form of software programs executed by microprocessors or digital signal processors (DSP), for example.

To summarize, in the LED backlight module and the driving apparatus thereof provided by the embodiments of the invention, the control circuit can count the time lengths of the disable period and the enable period of the dimming signal, so as to generate the first signal set and the second signal set, respectively. The adjustable voltage-divider circuit can adjust the dividing ratio according to the first signal set and the second signal set to generate the reference voltage. The reference voltage generated according to the dividing ratio can substantially represent the duty cycle of the dimming signal. Thus, the driving apparatus can achieve converting the PWM-based dimming signal into the reference voltage without connecting any external capacitor. In this way, the dimming signal even at a low frequency can be accurately converted into the reference voltage. In addition, as the duty cycle of the dimming signal is changed, the reference voltage is also changed, such that the feedback voltage and the current flowing through the LED string are also changed. Therefore, the brightness of the LED string can be accurately adjusted.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A light emitting diode (LED) driving apparatus, adapted to drive at least one LED string, the LED driving apparatus comprising:

a sensing resistor, having a first terminal coupled to a cathode of the at least one LED string to generate a feedback voltage and a second terminal coupled to a ground potential;

an adjustable voltage-divider circuit, configured to generate a reference voltage according to a dividing ratio, wherein the dividing ratio of the adjustable voltage-divider circuit is controlled by a first signal set and a second signal set;

a comparator, having a first input terminal coupled to the first terminal of the sensing resistor to receive the feedback voltage, a second input terminal coupled to the adjustable voltage-divider circuit to receive the reference voltage and an output terminal configured to generate a control signal;

a power converter, coupled between the output terminal of the comparator and an anode of the at least one LED string and configured to provide a DC voltage to the anode of the at least one LED string according to the control signal; and a control circuit, coupled to the adjustable voltage-divider circuit and configured to receive a dimming signal, wherein the control circuit counts a disable period of the dimming signal to generate the first signal set and counts an enable period of the dimming signal to generate the second signal set.

2. The LED driving apparatus according to claim 1, wherein the adjustable voltage-divider circuit comprises:

a first controllable resistor, having a first terminal coupled to a power potential and a second terminal coupled to a first node; and a second controllable resistor, having a first terminal coupled to the first node to generate the reference voltage and a second terminal coupled to the ground potential, wherein the first controllable resistor is controlled by the first signal set to adjust a resistance of the first controllable resistor, and the second controllable resistor is controlled by the second signal set to adjust a resistance of the second controllable resistor.

3. The LED driving apparatus according to claim 2, wherein an equivalent resistance of the first controllable resistor is positively correlated to a length of the disable period of the dimming signal, and an equivalent resistance of the second controllable resistor is positively correlated to a length of the enable period of the dimming signal.

4. The LED driving apparatus according to claim 2, wherein the first controllable resistor comprises:

a plurality of switching resistor modules, sequentially connected in series, wherein a first-stage switching resistor module among the switching resistor modules is coupled to the power potential, a last-stage switching resistor module among the switching resistor modules is coupled to the first node, and each of the switching resistor modules is controlled by at least one corresponding signal in the first signal set to change the resistance of the first controllable resistor.

5. The LED driving apparatus according to claim 4, wherein each of the switching resistor modules comprises:

a resistor module; and a switch module, connected in parallel to the resistor module and controlled by the at least one corresponding signal in the first signal set to determine a resistance of the switching resistor module.

6. The LED driving apparatus according to claim 5, wherein the resistor module comprises one or more resistors sequentially connected in series or connected in parallel with one another; and the switch module comprises one or more switches sequentially connected in series, and the switches are turned on/turned off respectively according to the at least one corresponding signal in the first signal set.

7. The LED driving apparatus according to claim 2, wherein the second controllable resistor comprises:

a plurality of switching resistor modules, sequentially connected in series, wherein a first-stage switching resistor module among the switching resistor modules is coupled to the first node, and a last-stage switching resistor module among the switching resistor modules is coupled to the ground potential, and each of the switching resistor modules is controlled by at least one corresponding signal in the second signal set to change the resistance of the second controllable resistor.

8. The LED driving apparatus according to claim 7, wherein each of the switching resistor modules comprises:

a resistor module; and a switch module, connected in parallel with the resistor module and controlled by the at least one corresponding signal in the second signal set to determine the resistance of the switching resistor module.

9. The LED driving apparatus according to claim 8, wherein the resistor module comprises one or more resistors sequentially connected in series or connected in parallel with one another; and the switch module comprises one or more switches sequentially connected in series, and the switches are turned on/turned off respectively according to the at least one corresponding signal in the second signal set.

10. The LED driving apparatus according to claim 1, wherein the control circuit comprises:

an edge detecting circuit, configured to receive the dimming signal and detect a rising edge and a falling edge of the dimming signal to generate a reset signal;

a counter, configured to receive an input clock signal and coupled to the edge detecting circuit to receive the reset signal, wherein the counter generates a count value in response to the input clock signal and resets the count value in response to the reset signal; and a sampling circuit, configured to receive the dimming signal and coupled to the counter to receive the count value, wherein the sampling circuit samples the count value according to the falling edge of the dimming signal to serve as the second signal set and samples the count value according to the rising edge of the dimming signal to serve as the first signal set.

11. An LED backlight module, comprising:

at least one LED string; and a driving apparatus, coupled to the at least one LED string to drive the at least one LED string, wherein the driving apparatus comprises:

a sensing resistor, having a first terminal couple to a cathode of the at least one LED string to generate a feedback voltage and a second terminal coupled to a ground potential;

an adjustable voltage-divider circuit, configured to generate a reference voltage according to a dividing ratio, wherein the dividing ratio of the adjustable voltage-divider circuit is controlled by a first signal set and a second signal set;

a comparator, having a first input terminal coupled to the first terminal of the sensing resistor to receive the feedback voltage, a second input terminal coupled to the adjustable voltage-divider circuit to receive the reference voltage and an output terminal configured to generate a control signal;

a power converter, coupled between the output terminal of the comparator and an anode of the at least one LED string and configured to provide a DC voltage to the anode of the at least one LED string according to the control signal; and a control circuit, coupled to the adjustable voltage-divider circuit and configured to receive a dimming signal, wherein the control circuit counts a disable period of the dimming signal to generate the first signal set and counts an enable period of the dimming signal to generate the second signal set.

12. The LED backlight module according to claim 11, wherein the adjustable voltage-divider circuit comprises:

a first controllable resistor, having a first terminal coupled to a power potential and a second terminal coupled to a first node; and a second controllable resistor, having a first terminal coupled to the first node to generate the reference voltage and a second terminal coupled to the ground potential, wherein the first controllable resistor is controlled by the first signal set to adjust a resistance of the first controllable resistor, and the second controllable resistor is controlled by the second signal set to adjust a resistance of the second controllable resistor.

13. The LED backlight module according to claim 12, wherein an equivalent resistance of the first controllable resistor is positively correlated to a length of the disable period of the dimming signal, and an equivalent resistance of the second controllable resistor is positively correlated to a length of the enable period of the dimming signal.

14. The LED backlight module according to claim 12, wherein the first controllable resistor comprises:

a plurality of switching resistor modules, sequentially connected in series, wherein a first-stage switching resistor module among the switching resistor modules is coupled to the power potential, and a last-stage switching resistor module among the switching resistor modules is coupled to the first node, and each of the switching resistor modules is controlled by at least one corresponding signal in the first signal set to change the resistance of the first controllable resistor.

15. The LED backlight module according to claim 14, wherein each of the switching resistor modules comprises:

a resistor module; and a switch module, connected in parallel to the resistor module and controlled by the at least one corresponding signal in the first signal set to determine a resistance of the switching resistor module.

16. The LED backlight module according to claim 12, wherein the second controllable resistor comprises:

a plurality of switching resistor modules, sequentially connected in series, wherein a first-stage switching resistor module among the switching resistor modules is coupled to the first node, and a last-stage switching resistor module among the switching resistor modules is coupled to the ground potential, and each of the switching resistor modules is controlled by at least one corresponding signal in the second signal set to change the resistance of the second controllable resistor.

17. The LED backlight module according to claim 16, wherein each of the switching resistor modules comprises:

a resistor module; and a switch module, connected in parallel with the resistor module and controlled by the at least one corresponding signal in the second signal set to determine the resistance of the switching resistor module.

18. The LED backlight module according to claim 11, wherein the control circuit comprises:

an edge detecting circuit, configured to receive the dimming signal and detect a rising edge and a falling edge of the dimming signal to generate a reset signal;

a counter, configured to receive an input clock signal and coupled to the edge detecting circuit to receive the reset signal, wherein the counter generates a count value in response to the input clock signal and resets the count value in response to the reset signal; and a sampling circuit, configured to receive the dimming signal and coupled to the counter to receive the count value, wherein the sampling circuit samples the count value according to the falling edge of the dimming signal to serve as the second signal set and samples the count value according to the rising edge of the dimming signal to serve as the first signal set.

* * * * *